US006317999B1

(12) United States Patent
Virta et al.

(10) Patent No.: US 6,317,999 B1
(45) Date of Patent: Nov. 20, 2001

(54) SEALING NOZZLE ARRANGED IN A BLOW BOX USED IN THE DRYING SECTION OF A PAPER MACHINE

(75) Inventors: Raimo Virta; Reijo Jokinen; Hannu Kokkala, all of Turku (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/686,762

(22) Filed: Oct. 12, 2000

(30) Foreign Application Priority Data

Oct. 22, 1999 (FI) ..... 990444 U

(51) Int. Cl.[7] ..... D06F 58/00; F26B 11/02
(52) U.S. Cl. ..... 34/114; 34/117
(58) Field of Search ..... 34/114, 117

(56) References Cited

U.S. PATENT DOCUMENTS

| | | | | |
|---|---|---|---|---|
| 3,633,284 | * | 1/1972 | Rodwin | 34/114 |
| 4,665,631 | * | 5/1987 | Villalobos | 34/114 |
| 4,716,660 | * | 1/1988 | Thiele | 34/114 |
| 4,891,891 | | 1/1990 | Wedel . | |
| 4,996,782 | | 3/1991 | Eivola . | |
| 5,230,168 | * | 7/1993 | Heinzmann et al. | 34/117 |
| 5,341,579 | | 8/1994 | Schiel et al. . | |
| 5,477,624 | | 12/1995 | Haessner et al. . | |
| 5,509,215 | * | 4/1996 | Koiranen et al. | 34/117 |
| 6,189,232 | * | 2/2001 | Milosavijevic et al. | 34/117 |

* cited by examiner

*Primary Examiner*—Teresa Walberg
*Assistant Examiner*—Leonid Fastovsky
(74) *Attorney, Agent, or Firm*—Nixon & Vanderhye P.C.

(57) ABSTRACT

A sealing nozzle is positioned in a blow box used in the drying section of a paper machine. The blow box is mounted on that side of the supporting fabric, which is away from the web at the opening gap between the supporting fabric and the cylinder and at a distance "D" from the supporting fabric. A passage is formed between the blow box and the supporting fabric, the passage having a negative pressure region having a border with a region outside the negative pressure region. The sealing nozzle is positioned in a wall of the blow box facing the passage at a distance "d" from the supporting fabric. The sealing nozzle includes: a pivotal sealing member mounted at the border, and a transverse support element, the sealing member pivotal about the transverse support element; and a separate nozzle part having at least one nozzle opening (e. g. a substantially transverse slit) and disposed in the negative pressure region in front of the pivotal sealing member, the separate nozzle part positioned so that the at least one nozzle opening blows air along a surface of the sealing member from the negative pressure region to the region outside the negative pressure region.

20 Claims, 2 Drawing Sheets

SEALING NOZZLE ARRANGED IN A BLOW BOX USED IN THE DRYING SECTION OF A PAPER MACHINE

BACKGROUND AND SUMMARY OF THE INVENTION

The present invention relates to a sealing nozzle arranged in a blow box used in the drying section of a paper machine defined in the preamble of the first claim presented below.

In the drying section of a paper machine the web is conveyed in a known manner by using either a single or a twin wire run. Single wire run means such a run where the web passes from one drying cylinder to the next supported by a single drying wire; the web passes also between the drying cylinders supported by the same wire. The web passes over the drying cylinder between the cylinder and the drying wire.

Twin wire run means such a run where separate top and bottom wires are used to support the web when it passes alternately over the lower and alternately over the upper drying cylinders. Also in this case the web passes over the drying cylinders between the cylinder and the drying wire. However, from an upper cylinder to a lower cylinder, or in the opposite direction, the web passes partly free, without support. The guide rolls of the drying wires are often located so that the wire and the web would disengage simultaneously from the drying cylinder, and so that the wire supports the web over a short distance as it passes from one cylinder row to the next.

In ever faster paper machines it has become a problem in that the web tends to become detached from the surface of the drying wire, at a point where the wire and the web together should travel from a drying cylinder to a redirecting cylinder or a guide roll located at a lower level.

The disengagement of the web from the wire leads easily to a wire break, or at least to the wire forming sacks or folds. The disengagement of the web from the wire leads thus to runnability problems, which are further emphasized when the speeds of the paper machines increase.

It is previously known, for instance from U.S. Pat. No. 4,905,380, to use different blow boxes in order to improve the runnability of a paper machine. The ejection blow created by the blow box induces a negative pressure region in the gap space between the drying wire and the wall of the blow box, and this negative pressure region keeps the web attached to the drying wire when the web passes from the drying cylinder to the guide roll below the cylinder.

However, a problem in the above-described solution is to have the negative pressure region induced by the blows safely sealed from the region left outside of the negative pressure region. In connection with running disturbances paper waste is generated, which as so called paper lumps or paper clumps are entrained by the web also to the blow boxes. Due to these bulges present in the web a blow box cannot be mounted at a short distance from the wire run, which would be optimal regarding the sealing. The blow box must be mounted at a certain safe distance, which is typically >50 mm, in which case the negative pressure region is not sealed in the best possible way. The effects of the ejection blows are also often insufficient when the blow nozzles of the blow boxes must be located at said safe distance from the wire.

It is known as such, for instance from U.S. Pat. No. 4,996,782, to use pivotable flaps to direct the air blows to a desired object, where the air is wanted to flow through the wire in order to ventilate the pocket formed by the wire loop. The object of the flap is not to seal the gap between the blow box and the wire.

The object of the present invention is to provide an improved sealing nozzle for the blow box in a paper machine.

An object is particularly to develop the previously known blow box solution so that the negative pressure effect can be even further intensified during the run.

An important goal of the invention is also to provide such a sealing nozzle of a blow box, with which the air blows providing the negative pressure, are generated as close as possible to the supporting fabric of a paper machine, such as a wire, moving past the blow box, and which nozzle is available both during the normal run and the threading.

A further object of the invention is to provide a sealing nozzle for a blow box which can be safely brought very close to the wire in order to provide ejection blows or ventilation of the pocket. Then an object is particularly to provide a sealing nozzle with a blow which can be directed accurately and which can provide the required pressure differences, however, retaining the operating safety of the structures.

In order to achieve the above-presented objects the new sealing nozzle for a blow box in the drying section of a paper machine according to the invention is characterized in what is presented in the characterizing part of the first claim presented below.

A typical blow box in which the invention is applied and used in the drying section of a paper machine is arranged in said drying section in the pocket space defined by the wire passing from the first drying cylinder to the second drying cylinder and a redirecting member arranged in this wire run, such as a redirecting cylinder, a guide roll, a suction roll or the like, in order to eject air away from said pocket space and to create a negative pressure region in at least a part of this pocket space. In the blow box, at the border between the desired negative pressure region and the region outside it, there is arranged one or more sealing nozzles according to the invention projecting from the blow box against the wire up to a certain distance "d" as seen from the wire, in order to create a seal between the negative pressure region and the region left outside the negative pressure region. Said sealing nozzle is advantageously combined with the blow box so that the member can be moved away from the wire by pushing or with the aid of an actuator, to a distance "d'" which is larger than the distance "d".

In this description of the invention and in the claims a blow box means typically box-like structures extending across the web or even structures of other shapes extending across the web, such as beam-like or tube-like structures, with which ejection air can be supplied into the pocket or a part of it.

A wire in this description means typically a drying wire, a felt or another corresponding fabric, with which the web is supported, for instance when the web passes over a drying cylinder.

The invention is applicable in the drying sections of paper machines utilizing both single wire runs and twin wire runs. In drying sections provided with a single wire run a blow box using a nozzle according to the invention can be used to create a negative pressure region and to seal it both in the travel direction in the region of the wire run from the first drying cylinder, or in the region called the "inlet side" in this description, and in the region of the wire run going to the next drying cylinder, or in the region called "outlet side" in this description, when the blow box is arranged in the pocket space defined by two drying cylinders, the wire runs between them and the redirecting cylinder below them.

In drying sections provided with twin wire runs a blow box according to the invention arranged in the wire pocket space defined by two drying cylinders, the wire runs between them and the wire guide roll, can be used to create a negative pressure region and seal it in the region of the wire run coming from the first drying cylinder, or at the inlet side. In the region of the wire run to the next drying cylinder, or on the outlet side, the blow box can be used to generate blows causing ventilation of the pocket.

The sealing solution according to the invention could of course be used also more generally in a paper machine or the like at a supporting fabric or e.g. at a roll, for preventing air from entering between this supporting fabric or roll and the blow box by ejecting air away from this intermediate space.

In an advantageous embodiment of the invention the sealing is conducted with a sealing nozzle having a sealing member which is arranged very close to the wire, and the actual nozzle part of the sealing member blows air from the blow box along the convex outer surface of this sealing member, in other words, along the convex surface which faces the wire. With this sealing nozzle air is blown on the inlet side of the wire, advantageously so that the air blow meets the wire before the wire disengages the cylinder located before the pocket, in which case the cylinder surface behind the web prevents the web from being disengaged from the wire due to the blow. Air is correspondingly blown with a sealing blow nozzle on the outlet side, so that the air meets the wire only when the gap between the wire and the cylinder after the pocket has closed, in which case the blow will not disengage the web from the wire.

A blow box according to the invention is typically arranged at a safe distance from the wire, which safe distance in a single wire run ranges typically between about 25 and 50 mm, and in a twin wire run >50 mm, even 100 mm. On the other hand, during normal run the sealing member according to the invention can be brought even closer than 15 mm from the wire, typically about 3 to 15 mm, advantageously to a distance of 5 to 10 mm. In this way the negative pressure effect created by ejection between the blow box and the wire can be intensified, and the gap can be sealed between the created negative pressure region and the region left outside the negative pressure region. The sealing member is flexible, pivotable or otherwise movable, so that when a paper lump or the like pushes the wire toward the blow box the sealing member can turn or move to a distance "d'" >20 mm, typically 20 to 50 mm, from the wire. This distance "d'" can be considered sufficient; the distance allows generally the paper lumps in question to pass the blow box without causing damage to it.

On the other hand, the sealing member can be integrated with an actuator, which in advance moves the member a short distance away from the position close to wire, if it is anticipated that wrinkled paper and paper lumps are entrained with the web in larger amounts than normally. During threading the actuator can move the sealing member to a distance of >20 mm, typically about 20 to 30 mm from the wire.

According to an advantageous embodiment of the invention the sealing member according to the invention is connected to a stationary blow box with the aid of a joint mechanism.

The nozzle part is typically formed by a nozzle part provided with a slit-like nozzle opening extending across the web, or by several nozzle parts arranged one after another across the web. The sealing blow nozzle is typically arranged in the front part of the gap between the blow box and the wire loop, as seen in the travel direction of the wire, in which case air can be ejected away from this gap with the aid of the sealing nozzle, and thereby the interfacing region extending across the web and formed in this way between the negative pressure region and the region left outside this negative pressure region can be sealed.

A blow box according to the invention can be formed mainly by a single uniform basic air box extending across the web, in which air box a sealing nozzle is arranged for blowing air and for sealing the negative pressure region at least on the inlet side of the wire run, when the inlet side refers to that part of the wire run where the wire arrives in the pocket. In a single wire run application another sealing nozzle according to the invention can be advantageously arranged on the other side of the blow box for blowing air into the outlet side of the wire run, in other words when it moves from the pocket to the next drying cylinder, in which case the whole pocket region defined by the blow box and the cylinders, the wire runs and the guide roll can be brought into a negative pressure. Whereas in a twin wire run application a conventional blowing nozzle can be arranged, instead of an ejecting nozzle, on the other side of the blow box, in other words on its outlet side, in which case the blowing nozzle creates ventilation on this side of the blow box.

A blow box according to the invention is often a box of the whole pocket, which, when the safety distances are observed, occupies substantially the whole pocket space, which is left between the drying cylinders and the redirecting cylinder or the like located overlapping therebelow, and which pocket space is defined by the wire. On the other hand a blow box according to the invention can be formed by two blow box parts located side by side and extending across the web, between which blow box parts a passage is formed, which can be closed with a sealing member, which passage connects the pocket space formed by the blow box and the wire loop with the space outside the wire loop.

The sealing member is advantageously arranged in the pocket on the inlet side of the wire, so that when the nozzle part projects toward the wire, for instance by a spring force, it will turn in a sector located in the travel direction of the wire, as seen from the turning joint. On the wire outlet side the sealing member turns correspondingly in a sector located in the opposite direction, as seen from the turning joint. The actual nozzle part is mounted in the sealing nozzle in the part located away from the turning joint, in other words adjacent the pivotable end of the sealing member. The sealing member is advantageously shaped so that its wall closest to the wire is convex, in which case, when the wire is pushed toward the sealing member it will easily glide past the member and will not be caught by the member, irrespective of the travel direction of the wire. Due to the Coda effect the blows coming from the nozzle part travel in a controlled manner over the convex surface, whereby the blows induce a negative pressure between the wire and the blow box. The air blows coming from the nozzle part also facilitate the gliding of the wire over the member.

A great improvement of the runnability of the drying section in a paper machine is achieved with the sealing nozzle solution according to the invention when the device according to the invention intensifies the negative pressure effect in the wire pockets during operation, and during threading on the other hand a very effective air removal from the pockets is provided. The negative pressure effect provided by the blow boxes can be particularly well intensified when the actual ejecting nozzles can be brought as close as possible to the wire and the web travelling with the wire. The paper web can be kept better attached to the wire on inlet side of the pocket, when the pressure regions of the pockets can be controlled by bringing the ejection air closer to the wire and by sealing the negative pressure regions better than previously from the surrounding air spaces. With the solution according to the invention it is still possible to keep the blow box structures at a suitable safety distance from the wire and to move the blow nozzles safely to the respective required safety distance, either automatically or by using an actuator.

Using the solution according to the invention in a normal single wire run it is often possible to reduce the air volumes in the redirecting suction rolls below the drying cylinders when the negative pressure effect is intensified with a blow box according to the invention in different locations of the pocket space.

According to one aspect of the present invention there is provided a sealing nozzle assembly disposed in the drying section of a paper machine in which a paper web is supported by a supporting fabric and guided over a cylinder so that the web is between the supporting fabric and the cylinder, the supporting fabric comprising a first side opposite the cylinder, and a second side adjacent the cylinder, the assembly comprising: A blow box, having a wall, mounted on the first side of the supporting fabric and spaced a distance D from the supporting fabric so as to define a passage between the blow box and the supporting fabric, the passage comprising a negative pressure region having a border with a region outside the negative pressure region. A sealing nozzle mounted in the wall of the blow box and facing the passage, and spaced a distance d from the supporting fabric. And the sealing nozzle comprising: a pivotal sealing member mounted at the border, and a transverse support element, the sealing member pivotal about the transverse support element; and a separate nozzle part having at least one nozzle opening and disposed in the negative pressure region in front of the pivotal sealing member, the separate nozzle part positioned so that the at least one nozzle opening blows air along a surface of the sealing member from the negative pressure region to the region outside the negative pressure region.

The nozzle part may comprise first and second nozzle lips defining the at least one opening of the nozzle, when the first nozzle lip is between the nozzle opening and the sealing member and is longer than the second nozzle lip. The nozzle may comprise a spring member which biases the sealing member against the first nozzle lip so that a minimal gap is left between the sealing member and the first nozzle lip. The at least one opening may comprise at least one slit substantially transverse to the web, preferably a plurality of successive slits substantially transverse to the web. The blow box may be positioned in a wire pocket formed between first and second drying cylinders in the drying section of the paper machine provided with a single wire run, and the first drying cylinder may have an opening gap, in which case the nozzle part is positioned at the opening gap and downstream of the sealing member in the travel direction of the wire run.

BRIEF DESCRIPTION OF THE DRAWINGS

Below the invention is described in more detail with reference to the enclosed drawings, in which.

DETAILED DESCRIPTION OF THE DRAWINGS

Figure 2:
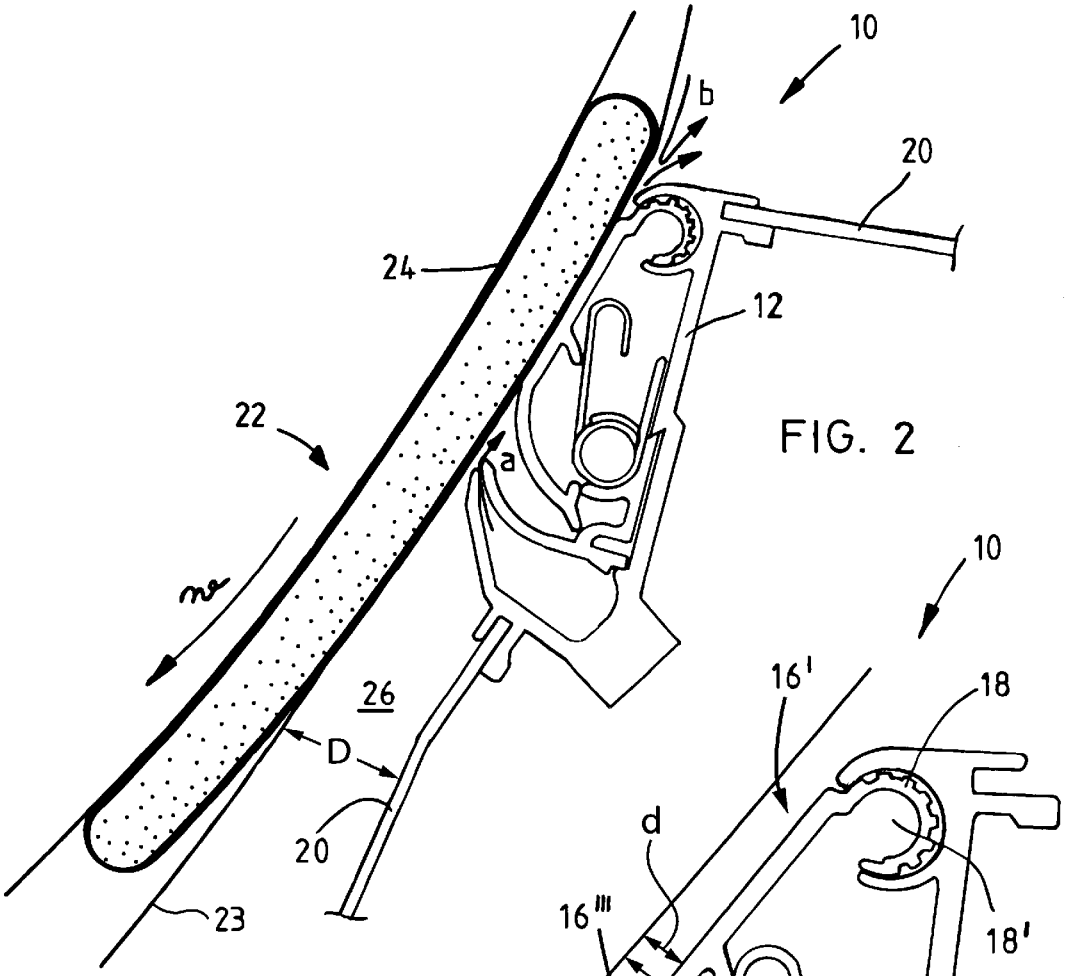
FIG. 2 shows the nozzle of FIG. 1 at the wire leaving the drying cylinder when a paper lump pushes the sealing member inwards.
Figure 3:
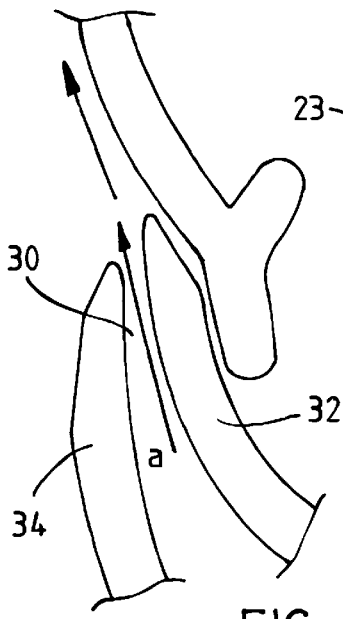
FIG. 3 shows an enlargement of the nozzle lips of the nozzle in FIG. 1.
Figure 1:
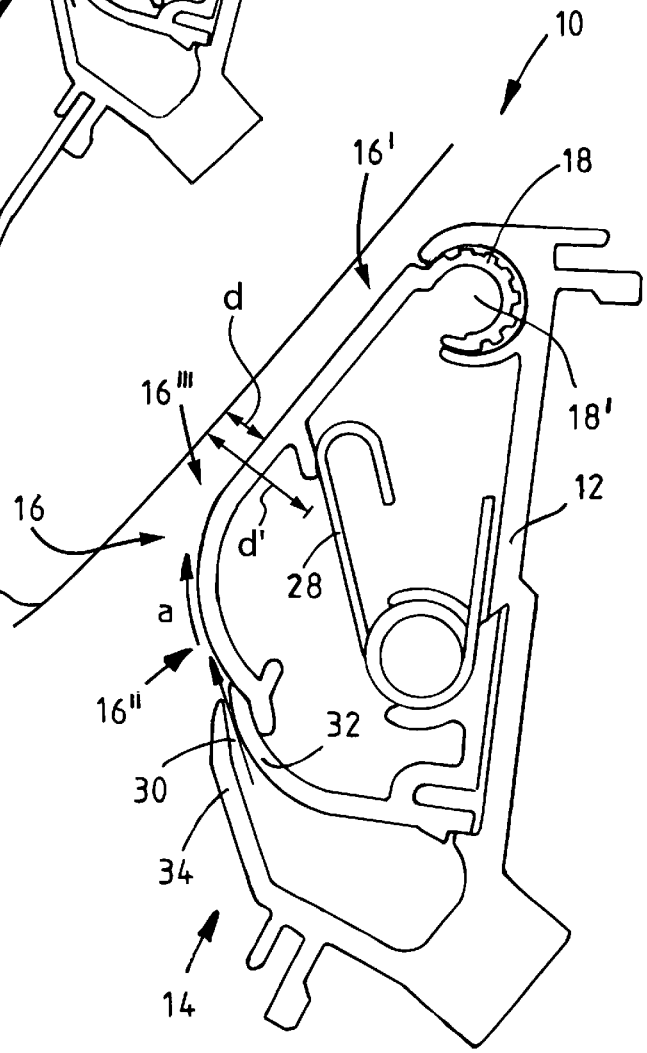
FIG. 1 shows schematically a sealing nozzle according to the invention in a vertical section in the machine direction, when the nozzles are in a normal running position.

FIGS. 1 and 2 present a sealing nozzle 10 according to the invention, which comprises an actual nozzle part 14 fixedly mounted in the frame structure 12 and a sealing member 16 mounted to the nozzle part so that it is able to turn. The sealing member 16 is at its first end 16' connected by a joint 18 to the frame part 12 so that it can turn around the axis 18'.

The sealing nozzle 10 can be fastened to the wall 20 of the blow box, as can be seen in FIG. 2. In FIG. 2 the sealing nozzle is mounted at that point 22 where the wire 23 normally disengages from the cylinder, or slightly upstream from this point regarding the wire run. FIG. 2 shows a case where a paper lump 24 travels between the wire and the cylinder.

The other end 16" of the sealing member extends mainly up to the nozzle part 14. The central part 16''' of the sealing member is convex toward the wire.

Air is blown from the nozzle part 14 against the travel direction of the wire, as shown by the arrows a and w. The air flows evenly along the convex, so called Coda surface of the sealing member, in which case it ejects air out from the passage 26 between the blow box and the wire. The air blown from the nozzle also prevents the boundary layer air travelling with the wire from reaching the passage 26, as shown with the arrow b.

A separate sealing member 16 can be a flap or the like made of a plate-like material, which typically has a length of 0.1 to 0.2 m in the travel direction of the wire. The flap has a light structure and it is easily moved away by the impact of a paper lump. A flap made of a plate-like material can be easily brought into the pocket space and it is easy to mount it in the blow box, both from the side of the machine and from above.

The nozzle part 14 is mounted in the blow box advantageously so that it is at a safety distance from the wire. Then paper lumps or the like conveyed with the wire can not reach the nozzle and damage it. The sealing member 16 is on the other hand mounted so that it extends very close to the wire, so that it should effectively seal the negative pressure region. Paper lumps and the like, which may travel with the wire, press the sealing member against the blow box, as seen in FIG. 2. The air blown by the nozzle part 14 forms an air cushion between the wire and the sealing member, thus preventing them from touching each other. On the other hand the sealing member forms a shield in front of the nozzle part. A movement of the sealing member closer to the blow box will not affect the size of the nozzle opening 30 of the nozzle part. The pivotable spring 28 turns the sealing member back to its normal position, in other words toward the wire, as soon as the paper lump has passed this point.

In order to create an air flow which is particularly even along the surface of the sealing member and in order to avoid turbulence the first lip 32 of the nozzle lips in the nozzle part can be smoothly brought very close to the surface of the sealing member. The first lip can be conically tapering, in which case the air flow can be brought very close to the sealing surface. Thus the surface of the first lip forms a mainly parallel extension to the upper surface of the sealing member. The spring 28 presses the sealing member against the nozzle lip 32.

The second lip 34 can be shorter than the first one, advantageously so that it does not project closer to the wire than the first lip. In this case the surface of the sealing member, not the nozzle lip, determines how close to the wire the sealing member can be brought. In this way the sealing member can be brought as close to the wire as possible, which has an advantageous effect on the ejecting flow and on the consequent sealing effect at the sealing nozzle. The negative pressure is created with a low energy consumption.

The path of the sealing member 16 can be controlled. The pivotable head 16" of the sealing member can for instance be arranged to hit some obstacle when the member has projected a suitable distance outwards toward the wire, and to ensure that the member cannot turn too close to the wire. In FIG. 1 the actual nozzle forms this obstacle. In addition or alternatively the turning motion of the sealing member can be controlled by control members which are connected to the actual joint 18 and which limit the path of the sealing member as desired. By controlling the path of the sealing member it is possible to control the ejecting air flow. When required the sealing member 16 can be pulled totally out from the passage 26 with the aid of control members.

Figure 4:
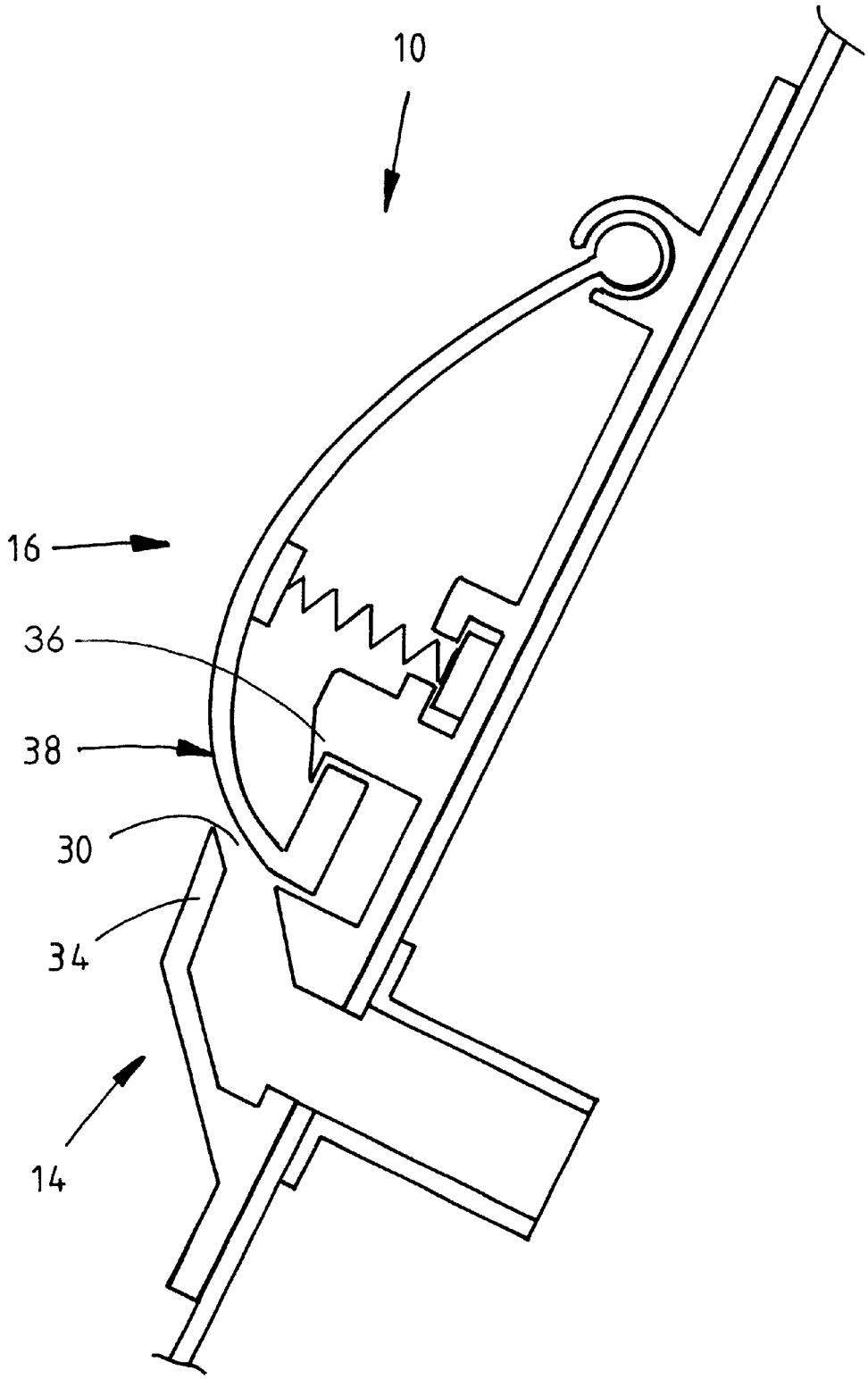
FIG. 4 shows another sealing nozzle according to the invention according to FIG. 1.

FIG. 4 shows another sealing nozzle 10. Where applicable, FIG. 4 uses the same reference numbers as FIGS. 1 and 2. The sealing nozzle is mainly of the same type as the nozzle in FIGS. 1 and 2. The sealing nozzle comprises a fixed nozzle part 14 and a pivotable sealing member 16, which has a convex Coda surface like the sealing nozzle of FIG. 1. However, in this nozzle a blocking body 36 is arranged to limit the outwards projecting movement of the sealing member 16.

The actual nozzle opening 30 is formed in this nozzle between the second lip 34 farther away from the sealing member and the external surface 38 of the sealing member. Thus air is blown from the nozzle direct on the convex surface of the sealing member.

A blow box according to the invention can, with the aid of ejecting blows (i.e. Pressure air flows) and the sealing member, intensify the negative pressure region created in the pocket between the drying cylinders, the wire and the guide roll, in order to improve the runnability of the paper machine. With the aid of the negative pressure effect it is possible to support the travel of the web, to avoid breaks in and bagging of the web. It has also been noted that an effective attachment of the web to the wire (for instance with a pressure of about 1000 Pa) on the runs between the drying cylinders will reduce the transversal shrinkage of the web.

The above invention was described with reference to exemplary advantageous embodiments, however, the intention is not to limit the invention closely to their details. Many modifications are possible within the scope of the inventive idea defined by the enclosed claims.

The above-described sealing nozzle can be used in blow boxes in a paper machine or the like, also in other places than in the above-described pockets. When required the blow box or the like can be arranged in connection with a supporting fabric of the machine at a distance "D" from the supporting fabric in order to eject air away from the gap between the supporting fabric and the blow box and/or in order to prevent air from entering from the outside into said gap. In this case the sealing member can be joined via a joint or another corresponding member which allows a controlled motion, to a fixed frame part in the blow box or the like, and it can be arranged to be kept at a distance "d" from the supporting fabric, in which case the distance "d" is shorter than the distance "D". A spring or said other member allows the sealing member to move away from the supporting fabric to a distance "d'" from the supporting fabric, due to a push directed at the sealing member and/or with the aid of an actuator, in which case the distance "d'" is larger than the distance "d", e.g. Ad' >20 mm (e.g. 20–30 mm).

The device according to the invention can also be used for sealing the negative pressure region at the edge regions of the supporting fabrics, and when required, even in the region of the cylinder.

The invention is not intended to be limited to the above presented embodiments of the invention. The intention is that the invention can be applied widely within the scope defined by the claims presented below.

In the solution according to the invention the sealing member 16 can thus be made for instance of metal, such as aluminium or steel, or it may be a casted ceramic body. On the other hand the sealing member can be made of an elastic material, such as rubber, plastic, a composite material, or a mixture of them. An elastic material provides extra flexibility to the sealing member. Particularly the Coda surface of the sealing member can be made of a flexible material. The sealing member can be made for instance of a hose-like material.

What is claimed is:

1. A sealing nozzle assembly disposed in the drying section of a paper machine in which a paper web is supported by a supporting fabric and guided over a cylinder so that the web is between the supporting fabric and the cylinder, the supporting fabric comprising a first side opposite the cylinder, and a second side adjacent the cylinder, said assembly comprising:

a blow box, having a wall, mounted on said first side of said supporting fabric and spaced a distance D from said supporting fabric so as to define a passage between said blow box and said supporting fabric, said passage comprising a negative pressure region having a border with a region outside said negative pressure region;

a sealing nozzle mounted in said wall of said blow box and facing said passage, and spaced a distance d from said supporting fabric; and said sealing nozzle comprising: a pivotal sealing member mounted at said border, and a transverse support element, said sealing member pivotal about said transverse support element; and a separate nozzle part having at least one nozzle opening and disposed in said negative pressure region in front of said pivotal sealing member, said separate nozzle part positioned so that said at least one nozzle opening blows air along a surface of said sealing member from said negative pressure region to said region outside said negative pressure region.

2. A nozzle assembly according to claim 1 wherein said nozzle part is fixed to said blow box.

3. A nozzle assembly according to claim 1 wherein said sealing member has a convex surface toward the supporting fabric.

4. A nozzle assembly according to claim 1 wherein said transverse support element is positioned at a first end of said sealing member, and said nozzle part is positioned in front of a second end of said sealing member.

5. A nozzle assembly according to claim 1 wherein said distance d is 3 to 15 mm, and said sealing member can be moved to a distance d', which is greater than d, from said supporting fabric when a protrusion on the web passes said box, and wherein d' is >20 mm.

6. A nozzle assembly according to claim 1 wherein said distance d is 3–15 mm; and further comprising an actuator; and wherein said sealing member is mounted for movement by said actuator to a distance d' from said supporting fabric, wherein d' is greater than 20 mm.

7. A nozzle assembly according to claim 5 further comprising an actuator; and wherein said sealing member is mounted for movement by said actuator to a distance d' from said supporting fabric, wherein d' is 20–30 mm.

8. A nozzle assembly according to claim 1 wherein said distance d is 5–10 mm; and further comprising an actuator; and wherein said sealing member is mounted for movement by said actuator to a distance d' from said supporting fabric, wherein d' is greater than 20 mm.

9. A nozzle assembly according to claim 1 wherein said distance d is 5–10 mm; and said sealing member can be moved to a distance d' from said supporting fabric when a protrusion on the web passes said blow box, wherein d' is greater than 20 mm.

10. A nozzle assembly according to claim 1 wherein said at least one nozzle opening comprises at least one slit substantially transverse to the web.

11. A nozzle assembly according to claim 1 wherein said at least one nozzle opening comprises a plurality of successive nozzle openings.

12. A nozzle assembly according to claim 11 wherein said nozzle openings comprise slits substantially transverse to the web.

13. A nozzle assembly according to claim 1 wherein said blow box is positioned in a wire pocket formed between first and second drying cylinders in the drying section of the paper machine provided with a single wire run, said first drying cylinder having an opening gap; and wherein said nozzle part is positioned in the opening gap and downstream of said sealing member in the travel direction of said wire run.

14. A nozzle according to claim 1 wherein said nozzle part comprises first and second nozzle lips defining said at least one opening of said nozzle, and wherein said first nozzle lip is between said nozzle opening and said sealing member and is longer than said second nozzle lip.

15. A nozzle according to claim 1 wherein said nozzle part comprises two nozzle lips defining said at least one nozzle opening of the nozzle, and wherein the nozzle lip, which is located away from said sealing member as seen from said nozzle opening is longer than the other nozzle lip, and said longer nozzle lip is positioned to extend close to the surface of said sealing member.

16. A nozzle according to claim 14 wherein said nozzle comprises a spring member which biases said sealing member against said first nozzle lip, so that a minimal gap is left between said sealing member and said first nozzle lip.

17. A nozzle according to claim 1 wherein said sealing member is formed of elastic material which can be pushed toward said blow box.

18. A nozzle assembly according to claim 1 wherein said sealing member has a convex Coanda surface made of a flexible material.

19. A nozzle assembly according to claim 13 wherein said distance d is 3–15 mm; and further comprising an actuator; and wherein said sealing member is mounted for movement by said actuator to a distance d' from said supporting fabric, wherein d' is greater than 20 mm.

20. A nozzle assembly according to claim 13 wherein said distance d is 3 to 15 mm, and said sealing member can be moved to a distance d', which is greater than d, from said supporting fabric when a protrusion on the web passes said box, and wherein d' is >20 mm.

* * * * *

UNITED STATES PATENT AND TRADEMARK OFFICE

CERTIFICATE OF CORRECTION

PATENT NO. : 6,317,999 B1
DATED : November 20, 2001
INVENTOR(S) : Virta et al.

It is certified that error appears in the above-identified patent and that said Letters Patent is hereby corrected as shown below:

Title page,
Delete "[75] Inventors: Raimo Virta; Reijo Jokinen; Hannu Kokkala, all of Turku (FI)" and insert therefor -- [75] Inventors: Raimo Virta, Turku; Reijo Jokinen, Raisio, Hannu Kokkala, Turku, all of (FI) --

Column 4,
Line 55, delete "Coda" and insert -- Coanda --;

Column 6,
Line 29, delete "Coda" and insert -- Coanda --;

Column 7,
Line 31, delete "Coda" and insert -- Coanda --;

Column 8,
Line 8, delete "Ad' >20 mm" and insert -- d' >20 mm --; and
Line 23, delete "Coda" and insert -- Coanda --.

Signed and Sealed this

Twentieth Day of August, 2002

*Attest:*

*Attesting Officer*

JAMES E. ROGAN
*Director of the United States Patent and Trademark Office*